US006216926B1

(12) United States Patent
Pratt

(10) Patent No.: US 6,216,926 B1
(45) Date of Patent: Apr. 17, 2001

(54) COMBINATION WORKOUT BACKPACK AND DETACHABLE BACKPACK BAG

(76) Inventor: Stephen W. Pratt, 181 Long Hill Rd. Apt. H2, Little Falls, NJ (US) 07424

( * ) Notice: Subject to any disclaimer, the term of this patent is extended or adjusted under 35 U.S.C. 154(b) by 0 days.

(21) Appl. No.: 09/332,825

(22) Filed: Jun. 14, 1999

(51) Int. Cl.[7] ..... A45F 5/00

(52) U.S. Cl. ..... 224/153; 224/148.2; 224/148.7; 224/580; 224/583; 224/645; 224/655; 482/105

(58) Field of Search ..... 224/153, 576, 224/578–583, 627, 644, 645, 653, 654, 655, 658, 907, 148.2, 148.4, 148.5, 148.7; 482/105

(56) References Cited

U.S. PATENT DOCUMENTS

| | | | | |
|---|---|---|---|---|
| 2,224,568 | * | 12/1940 | Altorfer | 224/578 |
| 4,303,239 | * | 12/1981 | Walsh, Jr. | 482/105 |
| 4,332,379 | | 6/1982 | Bannister | 272/119 |
| 4,344,620 | * | 8/1982 | Debski | 482/105 |
| 4,420,097 | * | 12/1983 | Motsenbocker | 224/148.7 X |
| 4,424,841 | * | 1/1984 | Smith | 224/582 X |
| 4,883,207 | | 11/1989 | McArthur | 224/153 |
| 4,944,509 | | 7/1990 | Snider | 272/119 |
| 5,092,506 | * | 3/1992 | Bolduc | 224/658 |
| 5,095,718 | * | 3/1992 | Ormond et al. | 224/580 X |
| 5,114,059 | * | 5/1992 | Thatcher | 224/148.5 |
| 5,120,288 | * | 6/1992 | Sinaki | 482/405 |
| 5,299,999 | | 4/1994 | Brine | 482/105 |
| 5,417,635 | | 5/1995 | Sell | 482/105 |
| 5,465,885 | * | 11/1995 | Wyatt | 224/148.2 |
| 5,509,279 | | 4/1996 | Brown et al. | 62/457.5 |
| 5,544,792 | * | 8/1996 | Arnwine | 224/580 X |
| 5,547,445 | * | 8/1996 | Chang | 482/105 |
| 5,634,576 | | 6/1997 | Arbel | 224/153 |
| 5,743,447 | * | 4/1998 | McDermott | 224/583 X |
| 5,799,851 | | 9/1998 | Wulf et al. | 224/583 |
| 5,819,999 | * | 10/1998 | Tennant | 224/153 X |

* cited by examiner

*Primary Examiner*—Gregory M. Vidovich
(74) *Attorney, Agent, or Firm*—Heslin & Rothenberg, P.C.

(57) ABSTRACT

A combination workout backpack and detachable backpack bag is disclosed in which the workout backpack and one or more standard weighted weight bags are used for training, i.e., building strength and endurance, for hiking. In addition, a detachable backpack bag is releasably attachable to the workout backpack so that the combination thereof, without the standard weighted weight bags, is designed for use as a conventional backpack for carrying various items when hiking. The workout backpack includes two vertically-extending, side-by-side, weight storage compartments which are conformable to one or more weight bags to inhibit horizontal and vertical movement of the standard weighted weight bags when training. A plurality of straps with releasable interlocking buckle clasps releasably attach a vertically-extending central portion, opposite lateral side portions, and a top portion of the workout backpack and to the detachable backpack bag to form an integral unit similar to a conventional backpack. Desirably, the workout backpack also includes a lower horizontal compartment for receiving a liquid container or medical bag.

28 Claims, 5 Drawing Sheets

COMBINATION WORKOUT BACKPACK AND DETACHABLE BACKPACK BAG

TECHNICAL FIELD

The present invention relates generally to backpacks, and more particularly to backpacks suitable for hiking and for training.

BACKGROUND INFORMATION

Backpacks are widely used by hikers such as travelers or campers to carry various items such as food, water, cook stoves, tents, sleeping bags, first-aid kits, flashlights, rain gear, maps, etc. In order to enjoyably reach out-of-the-way locations, a hiker needs to be physically fit to carrying a backpack which typically weighs about twenty-five to forty pounds when fully loaded with such items.

Various attempts have been made for building strength and endurance for hiking. For example, a hiker can train locally outdoors or in a gym with a fully loaded conventional backpack. However, a fully loaded convention backpack with its large size often calls attention to the hiker when training. In addition, particularly at a gym, a fully loaded conventional backpack limits movement of the hiker to avoid bumping into others or bumping into exercise equipment. In addition, it is often not practical to train with a fully loaded backpack which includes food items, thus requiring a hiker to find and use substitute items, such as metal, disk-shaped, free weights which can easily shift position in a conventional backpack when training.

Other attempts for building strength and endurance for hiking include specially designed exercise backpacks. For example, U.S. Pat. No. 4,332,379 to Bannister discloses a collapsible exercise backpack having a single compartment with an opening at the bottom for receiving a flexible weight carrying member, U.S. Pat. No. 4,944,509 to Snider discloses a weight lifting backpack which accepts standard sized, disk-shaped weights, and U.S. Pat. No. 5,299,999 to Brine discloses a rigid weight pack which receives rectangular-shaped planar weights.

A drawback of such prior art specially designed exercise backpacks is that they fail to provide a similar "feel", e.g., weight positioning and weight distribution compared to a conventional backpack for hiking, thereby limiting a hiker's ability to fully build strength and endurance. Furthermore, a hiker requires, in addition to the specially designed exercise backpacks for training, a separate conventional backpack for carrying items when hiking.

Therefore, there is a need for a low-cost, workout backpack suitable for optimizing training, as well as attachable to a detachable backpack bag suitable for carrying various items when hiking.

SUMMARY OF THE INVENTION

The above-mentioned drawbacks are overcome by the present invention which provides a combination workout backpack and detachable backpack bag which includes a workout backpack having at least one shoulder strap and at least one weight storage compartment in which is receivable at least one standard weighted weight therein, and a detachable backpack bag releasably attachable to the workout backpack. The workout backpack and the at least one standard weight is operable for training, and the workout backpack attached to the detachable backpack bag without the at least one standard weight is operable for hiking.

In one aspect of the present invention, the at least one weight storage compartment is sized so that the at least one standard weighted weight fits within and is restrained from horizontal movement in the at least one weight storage compartment. Desirably, the at least one weight storage compartment is adjustably conformable to a portion of the at least one standard weighed weight.

In another aspect of the present invention, the workout backpack releasably attaches to a central back portion, front lateral side portions, and a top portion of the detachable backpack bag.

In another aspect of the present invention, a plurality to standard weighted weights are provided and comprise a plurality of standard weighted flexible weight bags.

In still another aspect of the present invention, the at least one weight storage compartment comprises a plurality of elongated, vertically-extending, side-by-side weight storage compartments having a vertically-extending opening, and a plurality of releasably attachable safety straps extendable across the openings. The safety straps are also releasably attachable to a central back portion and lateral front side portions of the workout backpack.

In yet another aspect of the present invention, a rigid liquid container is receivable in the at least one weight storage compartment, and a drinking tube having an end is attachable to the liquid container. Desirably, the combination workout backpack and detachable backpack bag further includes a liquid storage compartment attached to the at least one weight storage compartment, a liquid container receivable in the liquid storage compartment, and a drinking tube having an end attachable to the liquid container.

Advantageously, by providing a workout backpack for training and a detachable backpack bag with attaches to the workout backpack for carrying items when hiking, a hiker is provided the same "feel" whether training or hiking, thereby aiding a hiker to optimize building strength and endurance when training. In addition, by providing weight storage compartments and standard weighted weights which are correspondingly sized, the weights are restrained and inhibited from shifting when training.

BRIEF DESCRIPTION OF THE DRAWINGS

The subject matter which is regarded as the invention is particularly pointed out and distinctly claimed in the concluding portion of the specification. The invention, however, together with further objects and advantages thereof, may best be understood by reference to the following detailed description of the preferred embodiments and the accompanying drawings in which:

DETAILED DESCRIPTION OF THE INVENTION

Figure 1:
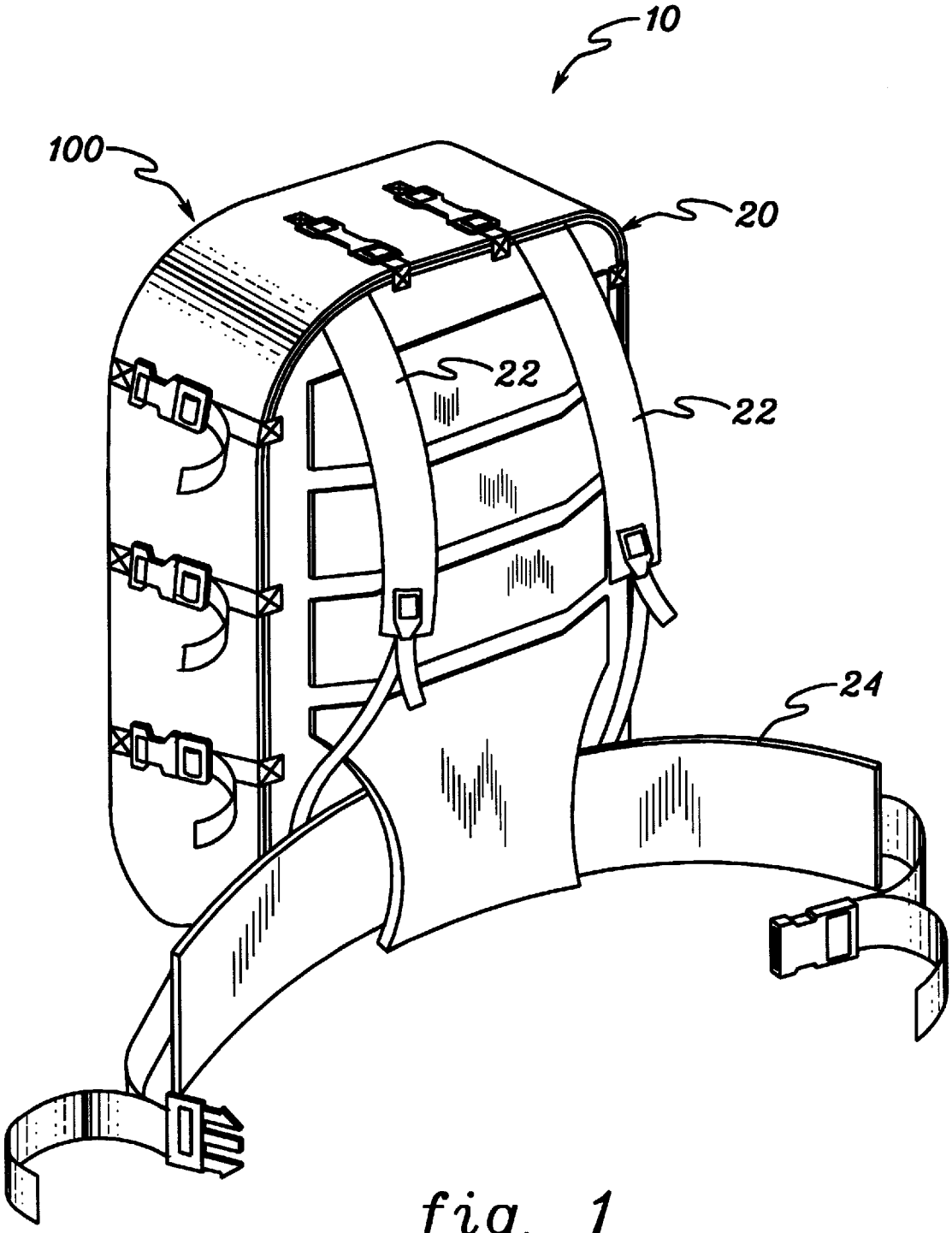
FIG. 1 is a perspective view of one embodiment of a combination workout backpack and detachable backpack bag according to the present invention.

FIG. 1 illustrates one embodiment of a combination workout backpack and detachable backpack bag according to the present invention which is generally designated as reference number 10 and which is readily attachable to and worn on the back of a hiker. As described in greater detail below, a workout backpack 20 (and standard weights not shown in FIG. 1) is designed to be used for training, i.e., building strength and endurance, for hiking. In addition, a detachable backpack bag 100 is releasably attachable to workout backpack 20 so that the combination thereof (without the standard weights) is designed for use as a conventional backpack for carrying various items when hiking.

Figure 2:
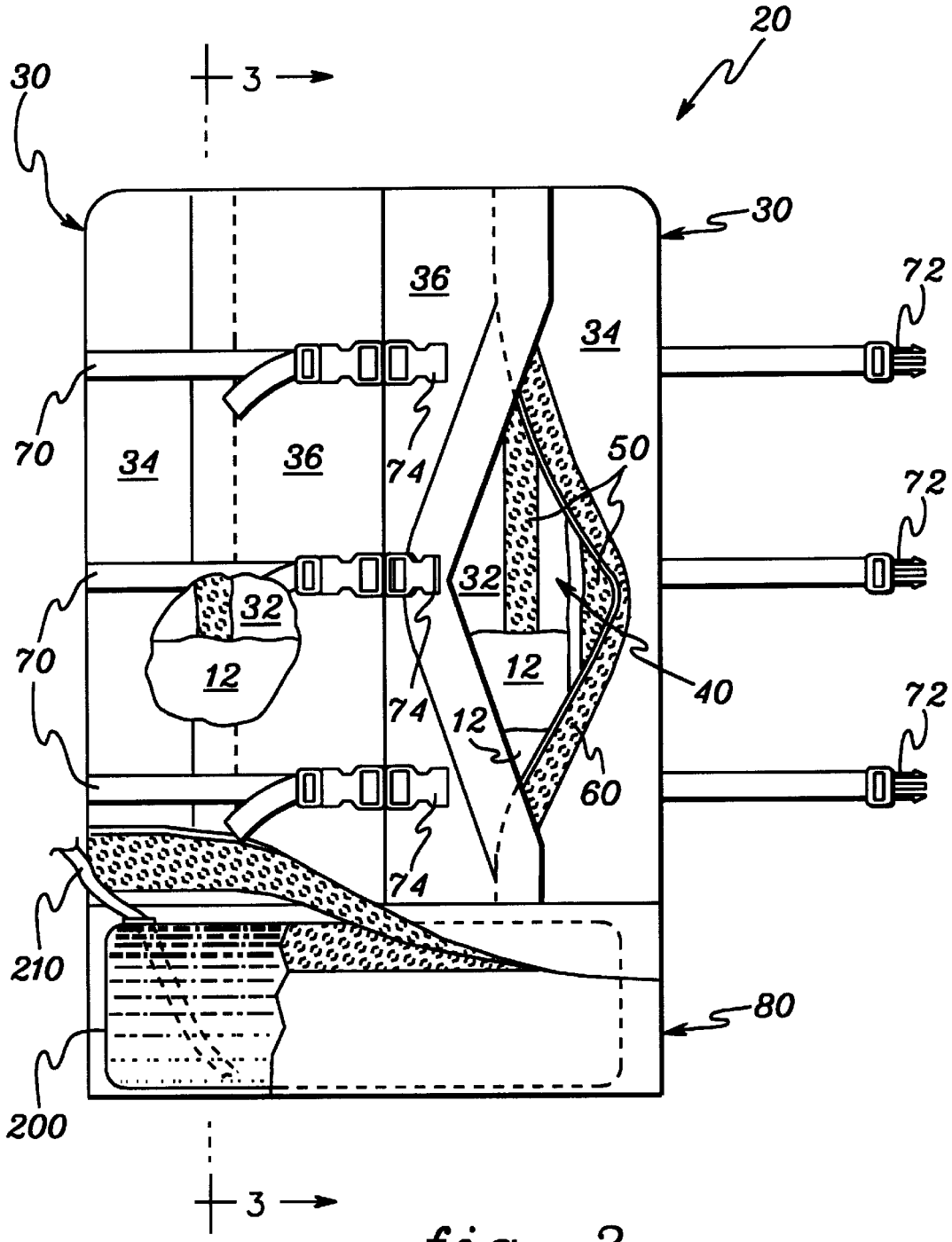
FIG. 2 is front elevational view of the workout backpack shown in FIG. 1 illustrating the weight storage compartments.

As shown in FIGS. 1 and 2, exemplary workout backpack 20 includes a pair of vertically-extending, side-by-side, weight storage compartments 30, a pair of adjustable shoulder carrying straps 22 (FIG. 1), and an adjustable waist strap 24 which enables workout backpack 20 to be worn on a person's back like a conventional backpack. Desirably, the portion of workout backpack 20 which faces the back of the hiker is padded.

Figure 3:
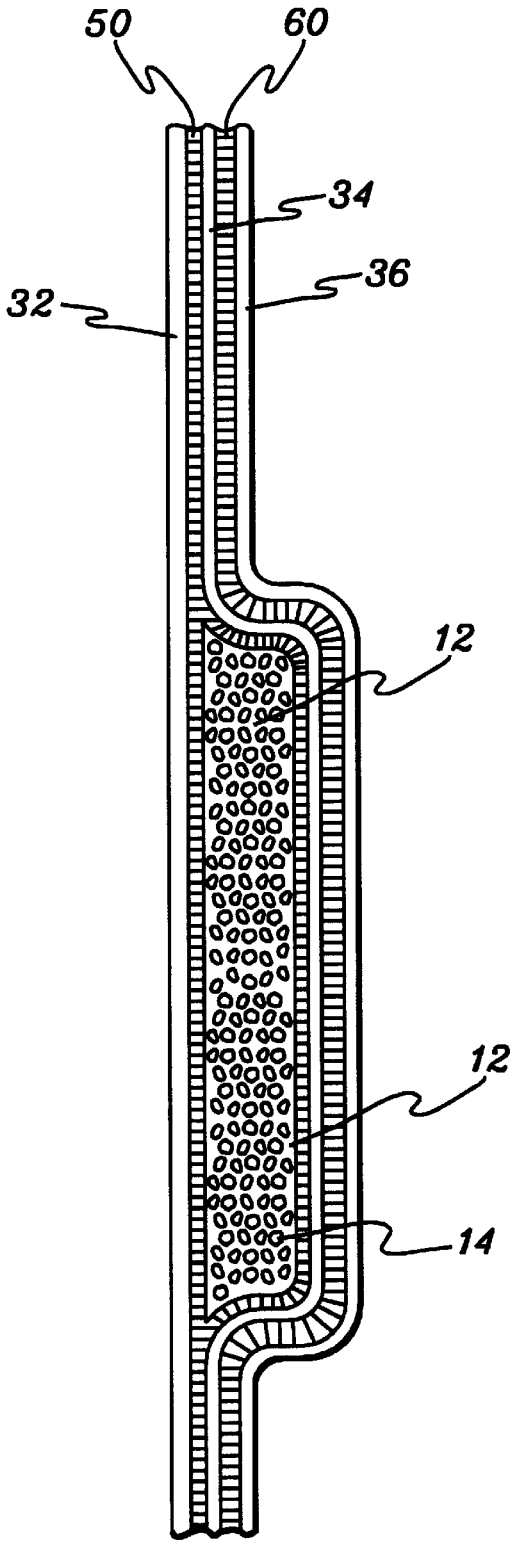
FIG. 3 is a partial cross-sectional view taken along line 3—3 of FIG. 2.

A plurality of standard weighted flexible weight bags 12 are readily placed in and fit within weight storage compartments 30. Desirably, weight bags 12 are symmetrically balanced in the weight storage compartments which are sized so that the weight bags are restrained from horizontal movement (as well as vertical movement as described below) during training. The standard weight bags may include a flexible outer shell containing therein a plurality of stainless steel or lead shot or pellets 14 (FIG. 3). The standard weight bags are desirably sized in five or ten pound increments or weight measures. Desirably, each weight storage compartment 30 is sized to receive four five-pound weight bags so that the workout backpack is operable to carry forty pounds of weight. As described in greater detail below, the weight storage compartments are adjustably conformable in size to one or more of the standard weight bags placed in the weight storage compartments.

Each weight storage compartment 30 includes a rear wall 32, and a first front web material 34 and a second front web material 36 which define between edge portions thereof an opening 40 to weight storage compartment 30. Desirably, edge portions of front web materials 34 and 36 overlap each other to close opening 40.

As best shown in FIG. 3, weight storage compartment 30 is conformable around a plurality of weight bags 12 placed and vertically stacked in-line therein. Advantageously, the conformable weight storage compartment is collapsible to maintain the position of the stacked standard weight and inhibit weight bags 12 from moving or shifting (horizontally and vertically) when the workout backpack is used by a hiker for exercising or training.

In this exemplary workout backpack, weight storage compartments 30 desirably have a width and a depth sized and corresponding to a width and a depth of the standard weighted weight bag to ensure that the standard weighted weight bags may be stacked one on top of another. In addition, attaching means are provided for releasably attaching rear wall 32 to first front web material 34, and first front web material 34 to second web material 36. For example, as shown in FIGS. 2 and 3, a first releasably interlocking mechanical fastener 50 releasably attaches rear wall 32 to first front web material 34, and a second releasably interlocking mechanical fastener 60 releasably attaches first front web material 34 to second front web material 36. Such releasably interlocking mechanical fasteners may include VELCRO® brand fasteners or the like.

In addition, a plurality of releasably attachable safety straps 70 may be provided which extend across openings 40 of weight storage compartments 30 to aid in maintaining openings 40 of weight storage compartments 30 in a closed position. As explained below, safety straps 70 are also operable for attaching detachable backpack bag 100 (FIG. 1) to workout backpack 20. Desirably, the safety straps attach to the central portion of workout backpack 20 and to the front lateral side portions of workout backpack 20. Desirably, releasable clasps or buckles, for example, a male buckle clasp 72 and a female buckle clasp 74 of straps 70, releasably attach to one another.

With reference again to FIG. 2, workout backpack 20 may further include a horizontally-extending liquid storage compartment 80 sized for receiving a rigid liquid container 200 suitable for carrying water or other liquids when training. Desirably, a drinking tube 210 is attached at one end to liquid container 200 so that a hiker is able to drink from liquid container 200 while working out. From the present invention, instead of a liquid container, other items can be carried in storage compartment 80 when working out, such as a portable tape or compact disc player, or a medical bag.

Figure 4:
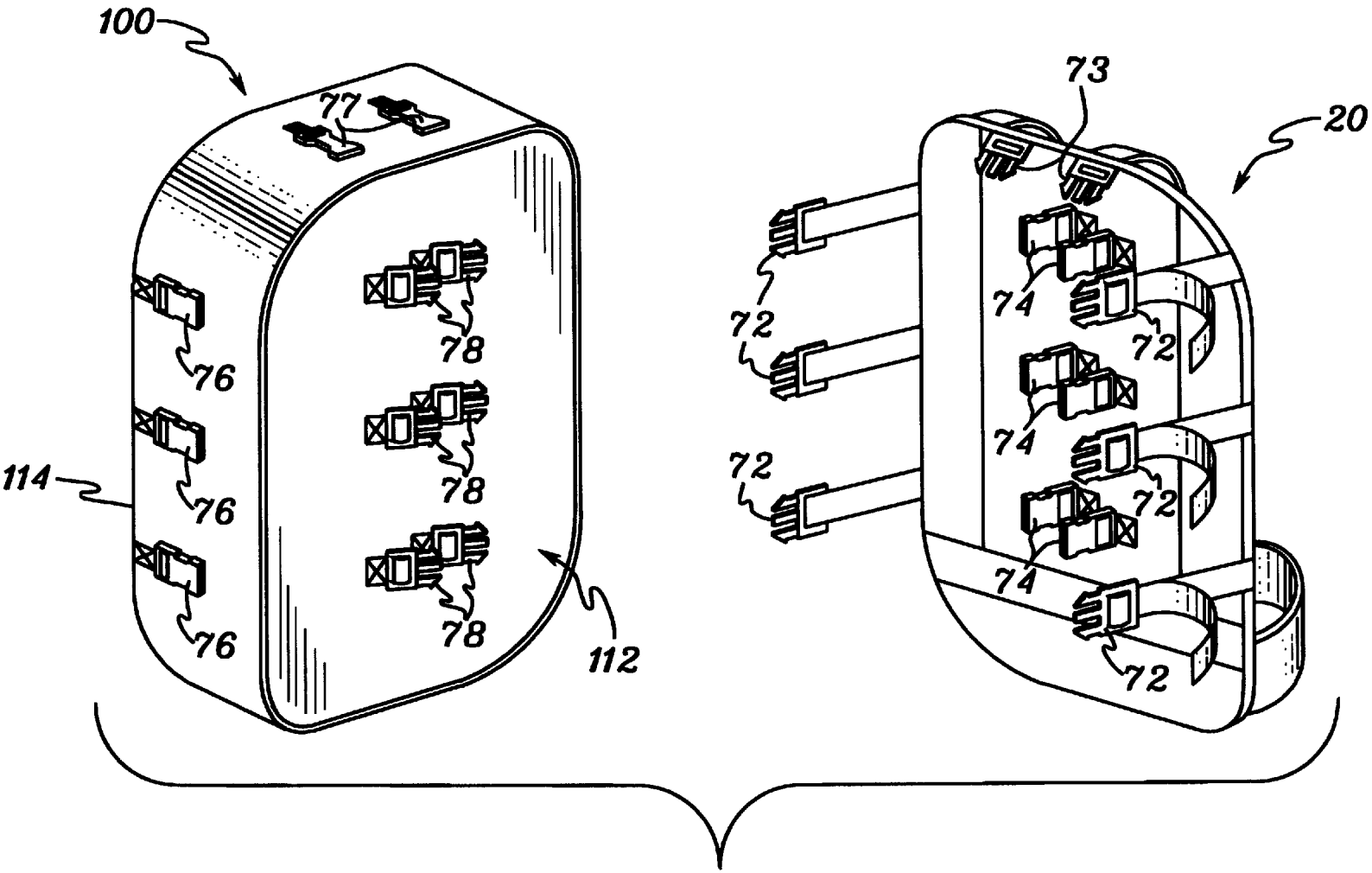
FIG. 4 is an exploded perspective view of the workout backpack and detachable backpack bag, shown in FIG. 1, illustrating the attachment of the workout backpack to the detachable backpack bag.

As shown in FIG. 4, detachable backpack bag 100 is provided with a plurality of female buckle clasps 76 (three on each lateral side of detachable backpack bag 100) which releasably and securely attach to male buckle clasps 72 of safety straps 70 (FIG. 2) of workout backpack 20. A plurality of male buckle clasps 78 is disposed along a central portion of detachable backpack bag 100, which attach to female buckle clasps 74 disposed along the central portion of workout backpack 20. Side straps allow the detachable backpack bag 100 to be pulled closely and tightly to workout backpack 20. Desirably, the top of workout backpack 20 and detachable backpack bag 100 are also provided with a pair of releasably interlocking buckles or clasps, for example, a male buckle clasp 73 and a female buckle clasp 77 which matingly engage each other.

With the standard weighted weights 12 and liquid container 80 removed from workout backpack 20, the plurality of straps allows detachable backpack bag 100 to be securely attach to workout backpack 20 so that the workout backpack and the detachable backpack bag in effect become an integral unit similar to a conventional backpack. Desirably, detachable backpack bag 100 comprises various compartments for storing and carrying items similar to a conventional backpack.

Figure 5:
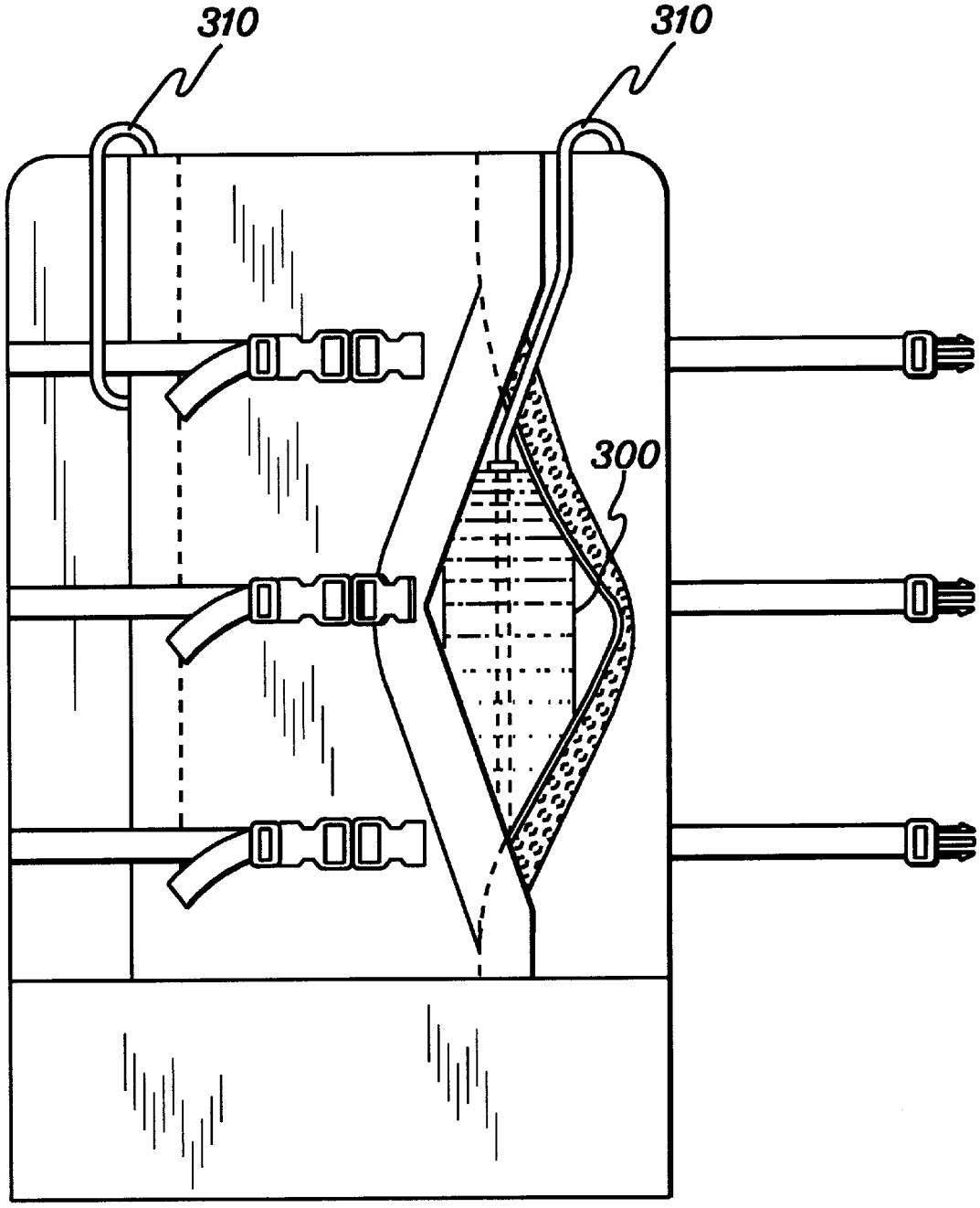
FIG. 5 is a front view of the workout backpack shown in FIG. 1 having liquid containers disposed in each of the side-by-side weight storage compartments.

With reference to FIG. 5, workout backpack 20 may also include a pair of rigid liquid containers 300 (only one of which is shown in FIG. 5) each being receivable in a respective one of weight storage compartments 30 prior to attaching workout backpack 20 to detachable backpack bag 100. Desirably, liquid containers 300 are fabricated from a rigid plastic so that when workout backpack 20 is attached to detachable backpack bags 100, the liquid contained within the liquid container is not compressed and forced out a drinking tube 310.

The workout backpack and detachable backpack bag may be formed from any convenient durable material such as plastic, vinyl, canvas, nylon, or leather. Preferably, the workout backpack and the detachable backpack bag are formed from a water resistant material such as a heavy reinforced CORDURA or similar fabric.

From the present description, it will be appreciated by those skilled in the art that more than two weight storage compartments may be provided in the workout backpack. It will also be appreciated that smaller sized liquid containers may be provided which fit in the weight storage compartments on top of the weight bags.

Thus, while various embodiments of the present invention have been illustrated and described, it will be appreciated to those skilled in the art that many changes and modifications may be made thereunto without departing from the spirit and scope of the invention.

What is claimed is:

1. A combination workout backpack and detachable backpack bag comprising:

a workout backpack having at least one shoulder strap and at least one weight storage compartment in which is receivable at least one standard weighted weight;

a detachable backpack bag releasably attachable to said workout backpack;

said at least one weight storage compartment comprising a rear wall, a first front web material, and a second front web material which define between said first front web material and said second front web material an opening, and at least one of:

a first releasably interlocking mechanical fastener for releasably attaching said rear wail to said first front web material, and a second releasably interlocking mechanical fastener for releasably attaching said first front web material to said second front web material; and a plurality of releasably attachable safety straps extendable across said opening, and said plurality of releasably attachable safety straps being operable to releasably attach to said detachable backpack bag; and wherein said workout backpack and the at least one standard weighted weight is operable for training, and wherein said workout backpack attached to said detachable backpack bag without the at least one standard weighted weight is operable for hiking.

2. The combination workout backpack and detachable backpack bag of claim 1 wherein said at least one weight storage compartment comprises said first releasably interlocking mechanical fastener and said second releasably interlocking mechanical fastener.

3. The combination workout backpack and detachable backpack bag of claim 1 wherein said at least one weight storage compartment comprises said plurality of releasably attachable safety straps.

4. The combination workout backpack and detachable backpack bag of claim 1 wherein said at least one weight storage compartment is sized so that the at least one standard weighted weight fits within and is restrained from horizontal movement in said at least one weight storage compartment.

5. The combination workout backpack and detachable backpack bag of claim 1 wherein said at least one weight storage compartment is adjustably conformable to a portion of the at least one standard weighted weight to inhibit horizontal and vertical movement of the at least one standard weighted weight in said at least one weight storage compartment.

6. The combination workout backpack and detachable backpack bag of claim 1 further comprising means for releasably attaching a top portion of said detachable backpack bag to said workout backpack.

7. The combination workout backpack and detachable backpack bag of claim 1 further comprising at least one standard weighted weight.

8. The combination workout backpack and detachable backpack bag of claim 7 wherein said at least one standard weighted weight comprises a standard weighted flexible weight bag.

9. The combination workout backpack and detachable backpack bag of claim 7 wherein said at least one standard weighted weight weighs five pounds.

10. The combination workout backpack and detachable backpack bag of claim 1 wherein said at least one weight storage compartment comprises a plurality of elongated, vertically-extending, side-by-side weight storage compartments.

11. The combination workout backpack and detachable backpack bag of claim 1 wherein said plurality of releasably attachable safety straps are releasably attachable to a central back portion and lateral front side portions of said detachable backpack bag.

12. The combination workout backpack and detachable backpack bag of claim 1 further comprising a liquid storage compartment attached to said at least one weight storage compartment, a liquid container receivable in said liquid storage compartment, and a drinking tube having an end attachable to said liquid container.

13. The combination workout backpack and detachable backpack bag of claim 1 further comprising a rigid liquid container receivable in said at least one weight storage compartment, and a drinking tube having an end attachable to said liquid container.

14. A combination workout backpack and detachable backpack bag comprising:

a workout backpack having at least one shoulder strap and at least one weight storage compartment in which is receivable at least one standard weighted weight, said at least one weight storage compartment comprising a rear wall, a first front web material, and a second front web material which define between said first front web material and said second front web material an opening, and means for releasably attaching said rear wall to said first front web material and said first front web material to said second front web material;

a detachable backpack bag releasably attachable to said workout backpack; and wherein said workout backpack and the at least one standard weighted weight is operable for training, and wherein said workout backpack attached to said detachable backpack bag without the at least one standard weighted weight is operable for hiking.

15. A workout backpack comprising:

at least one weight storage compartment in which is receivable at least one standard weighted weight, said at least one weight storage compartment comprising a rear wall and a first front web material and a second front web material which define between said first front web material and said second front web material an opening; and at least one shoulder strap attached to said at least one weight storage compartment; and at least one of:

a first releasably interlocking mechanical fastener for releasably attaching said rear wall to said first front web material, and a second releasably interlocking mechanical fastener for releasably attaching said first front web material to said second front web material; and a plurality of releasably attachable safety straps extendable across said opening, and said plurality of releasably attachable safety straps being operable to releasably attach to a detachable backpack bag.

16. The workout backpack of claim 15 wherein said at least one weight storage compartment comprises said first releasably interlocking mechanical fastener and said second releasably interlocking mechanical fastener.

17. The workout backpack of claim 15 wherein said at least one weight storage compartment comprises said plurality of releasably attachable safety straps.

18. The workout backpack of claim 15 wherein said at least one weight storage compartment is sized so that the at least one standard weighted weight fits within and is restrained from horizontal movement in said at least one weight storage compartment.

19. The workout backpack of claim 15 wherein said at least one weight storage compartment is adjustably conformable to a portion of the at least one standard weighted weight so that the at least one standard weighted weight is restrained from horizontal and vertical movement in said at least one weight storage compartment.

20. The workout backpack of claim 15 further comprising at least one standard weighted weight.

21. The workout backpack of claim 20 wherein said at least one standard weighted weights comprises a standard weighted flexible weight bag.

22. The workout backpack of claim 20 wherein said at least one standard weighted weight weighs five pounds.

23. The workout backpack of claim 15 wherein said at least one weight storage compartment comprises a plurality of vertically-extending, side-by-side, weight storage compartments.

24. The workout backpack of claim 15 further comprising a liquid storage compartment attached to said at least one weight storage compartment a liquid container receivable in said liquid storage compartment, and a drinking tube having an end attachable to said liquid container.

25. The workout backpack of claim 15 further comprising a liquid container receivable in said at least one weight storage compartment, and a drinking tube having an end attachable to said liquid container.

26. A workout backpack comprising:

at least one weight storage compartment in which is receivable at least one standard weighted weight, said weight storage compartment comprises a rear wall, and a first front web material and a second front web material which define between said first front web material and said second front web material an opening, and means for releasably attaching said rear wall to said first front web material and said first front web material to said second front web material; and at least one shoulder strap attached to said at least one weight storage compartment.

27. The workout backpack of claim 26 further comprising at least one standard weighted weight.

28. The workout backpack of claim 26 further comprising means for releasably attaching said workout backpack to a detachable backpack bag.

* * * * *

UNITED STATES PATENT AND TRADEMARK OFFICE

CERTIFICATE OF CORRECTION

PATENT NO. : 6,216,926 B1
DATED : April 17, 2001
INVENTOR(S) : Pratt

It is certified that error appears in the above-identified patent and that said Letters Patent is hereby corrected as shown below:

Column 5,
Line 20, delete "wail" and insert -- wall --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*